US006168691B1

(12) United States Patent
Kauper et al.

(10) Patent No.: US 6,168,691 B1
(45) Date of Patent: Jan. 2, 2001

(54) DEVICE FOR ELECTROCHEMICAL TREATMENT OF ELONGATE ARTICLES

(75) Inventors: Rudolf Kauper, Schwanstetten; Thomas Lummer, Greding; Wolfgang Richter, Berlin; Reinhard Silberhorn, Burgthann; Manfred Krepelka, Berlin, all of (DE)

(73) Assignee: Atotech Deutschland GmbH (DE)

( * ) Notice: Under 35 U.S.C. 154(b), the term of this patent shall be extended for 0 days.

(21) Appl. No.: 09/170,356

(22) Filed: Oct. 13, 1998

(30) Foreign Application Priority Data

| | | |
|---|---|---|
| Aug. 9, 1996 | (DE) | 196 32 132 |
| Jun. 2, 1997 | (DE) | 197 22 983 |
| Aug. 7, 1997 | (WO) | PCT/EP97/04341 |

(51) Int. Cl.[7] ..... C25D 17/00

(52) U.S. Cl. ..... 204/224 R; 204/297.5; 204/272; 204/DIG. 7

(58) Field of Search ..... 204/224 R, 297 W, 204/272, DIG. 7, 279, 278, 471, 297.05, 196.01

(56) References Cited

U.S. PATENT DOCUMENTS

| | | | | |
|---|---|---|---|---|
| 3,113,080 | * | 12/1963 | Andrus | 205/441 |
| 4,303,481 | | 12/1981 | Mortier et al. . | |
| 4,323,433 | * | 4/1982 | Loch | 205/145 |
| 4,359,366 | | 11/1982 | Eidschun . | |
| 4,385,967 | * | 5/1983 | Brady et al. | 257/488 |
| 4,419,194 | | 12/1983 | Angelini . | |
| 4,659,447 | | 4/1987 | Anzola . | |
| 4,772,367 | * | 9/1988 | Menzel et al. | 205/653 |
| 5,401,370 | * | 3/1995 | Kauper et al. | 204/228.2 |

FOREIGN PATENT DOCUMENTS

| | | |
|---|---|---|
| 1 103 103 | 3/1961 | (DE) . |
| 25 24 315 | 6/1975 | (DE) . |
| 0 024 964 | 3/1981 | (EP) . |
| 0 196 251 | 10/1986 | (EP) . |
| 52-224700 | 10/1987 | (JP) . |

* cited by examiner

*Primary Examiner*—Kathryn Gorgos
*Assistant Examiner*—Wesley A. Nicolas
(74) *Attorney, Agent, or Firm*—Paul & Paul

(57) ABSTRACT

A method and a device are described for the electrochemical treatment of elongate articles, preferably bars. The article 10 is clamped at one end by means of a clamp 3 and is introduced into a hollow chamber that has a longitudinal axis, in an electrode 30, arranged in a dip bath with a periphery parallel to the axis, in as concentrically axial a manner as possible and is thereby directed through at least one axially displaceable, perforated screening mask 23,26 so that part of the area not to be treated electrochemically is screened from the electrode. The article and electrode are connected to a current source. A container 14 for treatment liquid has at least one electrode 30 therein, the electrode having a hollow chamber with a longitudinal axis and a periphery parallel to the axis. The article is introduced into the hollow chamber. At lease one screening mask 23,26 is axially adjustable within the hollow chamber and has openings for introducing the article. The mask can prevent electrochemical treatment of the article in specific areas. A current source and electrical connections are provided to the electrode and to the article.

14 Claims, 6 Drawing Sheets

DEVICE FOR ELECTROCHEMICAL TREATMENT OF ELONGATE ARTICLES

CROSS-REFERENCE TO RELATED APPLICATIONS

This a continuation of International Appln. PCT/EP97/04341 filed Aug. 7, 1997 which designated the United States and is now abandoned, which is based on German Patent Applications 196 32 132.8 filed Aug. 9, 1996 and 197 22 983.2 filed Jun. 2, 1997.

The invention relates to a method and device for the electrochemical treatment of elongate articles, in particular for the electrochemical etching or plating of a preferably bar-shaped item to be treated.

It is known to treat elongate cylinders, for example vehicle shock absorbers, piston rods or disc valve stems electrochemically to improve the abrasion and corrosion properties. With these methods which are used in practice, the bars are only coated electrolytically with hard chrome on the surfaces stressed in a later operation. The remaining areas of the bars are supposed to remain uncoated or almost uncoated. In order to improve the adhesion of the chrome layer on the bars, the surface is electrochemically etched in advance. For both stages in the procedure, insoluble electrodes are preferably used. The bars are treated preferably in dip bath units, treatment solution adhering to the bars after treatment being rinsed off again. A transportation device takes care of the transportation of the bars from bath to bath.

Since the bars may only be chromium-plated in the central region, their ends must be masked, i.e. screened in such a manner that, in exactly prescribed areas of the bars, no metal is deposited. The boundaries between the areas to be coated and those not to be coated are prescribed, small tolerances being maintained. With shock absorber cylinders, the transition between the areas to be coated and those not to be coated must be kept for example within±3 millimetres. The hard chromium layer must be uniformly thick right up to these boundaries. An increase or decrease in the layer thickness at these boundaries must be avoided. Furthermore, the layer must be totally uniformly thick over the entire bar periphery so that subsequent processing by polishing can be avoided.

For electrochemical treatment in known dip bath units, the bars are inserted on mountings which in turn are secured on transportable goods carriers. The mountings are provided with individual masks so that both bar ends are not coated in the intended area. Since various shock absorber cylinders with variable bar lengths, diameters and coating areas are to be treated in the central area of the bar, masks and mountings must be supplied in adequate number. The mountings are loaded with the bars by hand since the large product spectrum occurring in practice is not easily accessible to automation.

The mounting technique is also disadvantageous on account of the two-part masks to be used and because of the current supplies. Using tube-shaped electrodes to surround the bar in the electrochemical cell is not possible with the known mountings since a bar, which is secured to the mounting on both sides normally, cannot be introduced into an electrode of this type. For this reason, the electrodes are separated and stand opposite the bars on only two sides. Consequently, a uniformly thick layer is not deposited on the bars. A thicker layer is deposited on the bars at the areas lying opposite the electrodes than in the other areas. For this reason, the non-uniformly coated bar must be subsequently ground cylindrically. When coating with hard chrome, this subsequent mechanical processing represents a considerable cost factor.

The known mountings for dip bath units lead to considerable carry-over of the electrolyte liquid and the rinsing water from one bath to the subsequent one. Because of the masks and fixings which are secured to the mountings, carry-over becomes particularly great. Many rinsing stages must therefore be provided to avoid the carry-over of chromic acid particularly when coating with a hard chrome deposit. Because of the aggressiveness of this acid, very high demands are made on the properties of the materials which come into contact with the treatment solutions with respect to corrosion resistance. Synthetic materials are best suited to this purpose. On the other hand, the mountings for supplying the bath current to the bars must be electrically conductive and therefore must preferably be made of metal. The metal must therefore be protected by a plastic coating. This is however subject to defects.

After treatment in the active baths, the workpieces and mountings must be rinsed very carefully especially when, because of the masks used for screening the areas on the workpiece which have not to be coated, high carry-over has to be taken into account. In order to avoid this problem, an electroplating mounting is proposed in the publication DE 25 24 315 A1 for receiving a plurality of bar-shaped preferably cylindrical objects, such for example as piston rods. The cylindrical rods contained in collar-shaped receiving parts should be coated at the periphery with as uniform a layer thickness as possible. Since the anodes lying opposite the bars on both sides cause an elliptical distribution of layer thickness, however, it is suggested that the bars be turned around their longitudinal axis during the electrochemical treatment. By means of protective shells, which are longitudinally adjustable and individually coordinated to the item to be treated, the metal layer is delimited at their ends in the longitudinal direction of the bars. The plating mounting is designed in such a way that it can be accommodated to the length of the bar by means of vertically adjustable side parts.

Even when subsequent mechanical processing can be dispensed with by virtue of these measures, the method is technically exceptionally demanding since it is necessary to replace each individual rod in the aggressive bath in rotation. Furthermore, because of the rotation technically demanding solutions are required for transferring the generally very high electroplating current onto the rod, for example by means of brushes.

Another solution to the sketched problem is described in the publication DE-AS 11 03 103. A device is presented there for partial electroplating of elongate cylindrical bodies (disc valve stems). These bodies are arranged concentrically in tube-shaped anodes and are secured at one end in a stepped metal core. The cathodic current is supplied via this metal core. The metal core is separated from the electrolytic cell by an insulating body. The metal core and the insulating body delimit the electroplating layer at the upper end of the item to be treated. The lower end is protected by a protective lacquer from unwanted electroplating.

Since every single body to be electroplated must be individually secured in this embodiment and in addition since the protective lacquer for masking the one end area of the item to be treated must be applied to accurat dimensions and be removed again after completion of the electroplating, the described method is technically demanding and thus likewise disadvantageous.

Therefore, the problem underlying the present invention is to avoid the disadvantages of the known methods and devices and to make possible in particular uniform electrochemical treatment of elongate articles, simple screening of the articles at the areas which have not to be treated, exact delimitation of the areas to be treated being achieved within narrow tolerances, a small degree of carry-over of the treatment liquids and rinsing liquids from one bath to the next and a reasonably priced electrochemical treatment of articles with various dimensions. In addition, it should be possible to process many articles at the same time.

According to the invention, elongate articles, preferably bars, especially round rods, which if necessary are tapered at the ends or are provided with a thread, are treated electrochemically using a method with the following essential procedural steps:

a) clamping of at least one article at one end by means of a preferably electrically conductive clamp;

b) axial transference in as concentric a manner as possible of the object held by the clamp into a hollow chamber with a longitudinal axis in an electrode which is arranged in a dip bath and which has a periphery parallel to the axis, c) the article being thereby directed through at least one axially displaceable perforated screening mask in such a manner that an area of the article to be treated electrochemically lies opposite the periphery and an area which has not to be treated is screened from the electrode;

d) supply of an anodic or cathodic bath current to the article by connecting the article electrically to a terminal of a current source and the electrode to the other terminal of the current source, the bath current being supplied to the article preferably via the clamp when the latter is electrically conductive.

For this purpose, a device is used which has the following features.

a) a container for containing a treatment liquid a1) with at least one electrode contained therein for the electrochemical treatment of an article, a2) the electrode having a hollow chamber with a longitudinal axis and a periphery parallel to the axis into which hollow chamber the article may be inserted, b) at least one screening mask which is arranged axially displaceable within the hollow chamber, is provided with openings for introducing the article and which is designed in such a way that it prevents the electrochemical treatment of the article in certain areas, and c) at least one current source and electrical connections from one connection terminal of the current source to the electrode and from the other connection terminal to the article which may be introduced into the electrode.

With the method and device, preferably cylinders for vehicle shock absorbers and other bar-shaped parts such as for example disc valve stems can be coated. The invention is not restricted however to the treatment of round rods; articles with other cross-sections can also be treated. For each bar there is an electrolytic single cell provided with defined adjustable masks with sealing means in the form of closing collars at both ends of the bar for delimiting the surfaces to be treated. The single cell comprises essentially an electrode with a hollow chamber which is preferably designed like a tube. Said single cell is arranged essentially vertically in the dip bath. Consequently, the bars can be sunk into the dip bath and can be lifted out again from the latter preferably in a vertical position with the result that the quantity of entrainment from one bath to the next is minimised. Each bar is introduced into a single cell of this type. The tube-shaped electrodes are of the length required for the longest bar to be treated.

The area to be treated electrochemically on the article is adjusted by means of a relative axial movement between the article and the screening mask to one another. A further option resides in adjusting the area to be treated electrochemically on the article by means of the depth to which the article is plunged in the dip bath. The screening mask is designed as a covering partly surrounding the article in an axial direction. In order to establish exactly the boundary of the area to be treated electrochemically, a sealing means, which abuts the periphery of the hollow chamber, is provided furthermore on the screening mask. The covering is preferably tube-shaped. The mask forms a seal in an axial direction with the sealing means which is designed preferably in the form of collar. The bar to be treated is introduced concentrically into the electrode up to the place of deposit of the goods carrier by means of at least an upper collar. For this purpose, the sealing means has an opening for introducing the article. If a tube-shaped electrode is used, the collar is circular and the opening is provided in the centre of the collar. The screening mask is held in the dip bath by a suitable means (mounting). Furthermore, a device is provided for the axial height adjustment of the screening mask. As well as an upper screening mask, a lower screening mask can also be arranged in the electrodes. By means of mutually independent adjustment of the upper and lower masks in an axial direction, both coating boundaries on the bar are uniformly adjusted for each goods carrier on which all the articles to be treated are installed or which is adjusted for each row of goods carriers on which several articles to be treated are installed. A new accommodation of these adjustments is only required when changing the dimensions of the item to be treated on a subsequent goods carrier or a subsequent row of goods carriers.

The bath current is supplied to the articles via the goods carrier and via the electrically conductive clamp. The individual electrodes are connected individually or together to the opposite terminal of the bath current source.

The clamp for the article comprises essentially a stationary and a moving member and also jaws secured to the members. The article is clamped by a means exerting a closing pressure on the jaws.

By means of the method according to the invention and the device, the disadvantages of the known mounting technique are avoided. Individual masks for each bar dimension, for example for plating caps or holding devices, are not required. Mountings are not used. A product change from one goods carrier to the next is possible without time-wasting refitting of masks and holding devices. The unit can be loaded quickly and simply with the parts to be plated since the loading is restricted to the introduction on one side of the article into the clamp which then only needs to be closed. This procedure is simple to automate even with bars of varying dimensions.

After electrochemical treatment, the bars can be raised out of the bath and transferred to the subsequent treatment bath without losing time since the treatment solution or the rinsing water drips off quickly as the lower bar ends are free of masks and holding devices. At the upper end there is situated only one clamp with a small surface area so that altogether only small quantities of liquid are entrained.

It is possible to position the bar in the centre of a tube electrode using this method. The distance of all surface regions to the electrode wall situated opposite is equally great over the entire circumference. This is a condition for uniform electrochemical treatment, for example coating. As a result, the bars no longer need to be mechanically reprocessed.

By using the clamp according to the invention with a stationary and a moving member and when treating bars with a large variety of diameters, the position of the bar axis to the clamp axis is changed. This can be compensated for by varying the position of the clamp while lowering the clamp onto the single cell. Two different lowering positions suffice thereby with the normally occurring bar diameters to provide all the bar diameters occurring with an adequately uniform coating.

Since the screening masks in the single cells are applied in a stationary manner, only the item to be treated and the metallic pincers which are moistened with treatment liquid need to be conveyed from station to station. All further bath fittings apart from the metal pincers with the counter electrode are not electrically conductive. They can be produced from resistant plastic material.

In order to be able to treat electrochemically articles which have varying dimensions, further preferred embodiments of the sealing means are proposed: in order to treat elongate articles, for example bars, with varying diameters, two sealing means in the form of collars applied one above the other are used, each having an opening respectively for introducing the article and for directing the latter through and also having radial incisions extending towards the openings and the incisions of both sealing means being arranged offset to one another. Furthermore, several sealing means can also be provided which are located one above the other in the form of collars and which have openings for introducing the article with varying diameters. In order to increase the mechanical flexibility of the sealing means at the penetration point for the bars, sealing means with a thickness decreasing towards the opening are used preferably.

In order to further improve the screening in the screened area, at least one additional metal body can be provided which is connected electrically to the article and which is arranged in an axial direction on the far side of the sealing means in the area which is not to be treated electrochemically. By using said metal body, the distribution of electrical field lines focused on the article is reduced so that the threshold value for the electrochemical treatment in this area is no longer exceeded.

In order to control the current density at the edge of the surface to be coated, the covering surrounding the article may furthermore be extended into the area to be treated electrochemically.

A further preferred embodiment resides in using perforated electrodes. As a consequence, it is possible to convey the treatment solution contained in the dip bath through the perforations in the electrode against the article, in order to achieve targeted streaming and hence to influence the electrochemical treatment process.

The subsequent Figures serve to explain the invention further:

Figure 1:
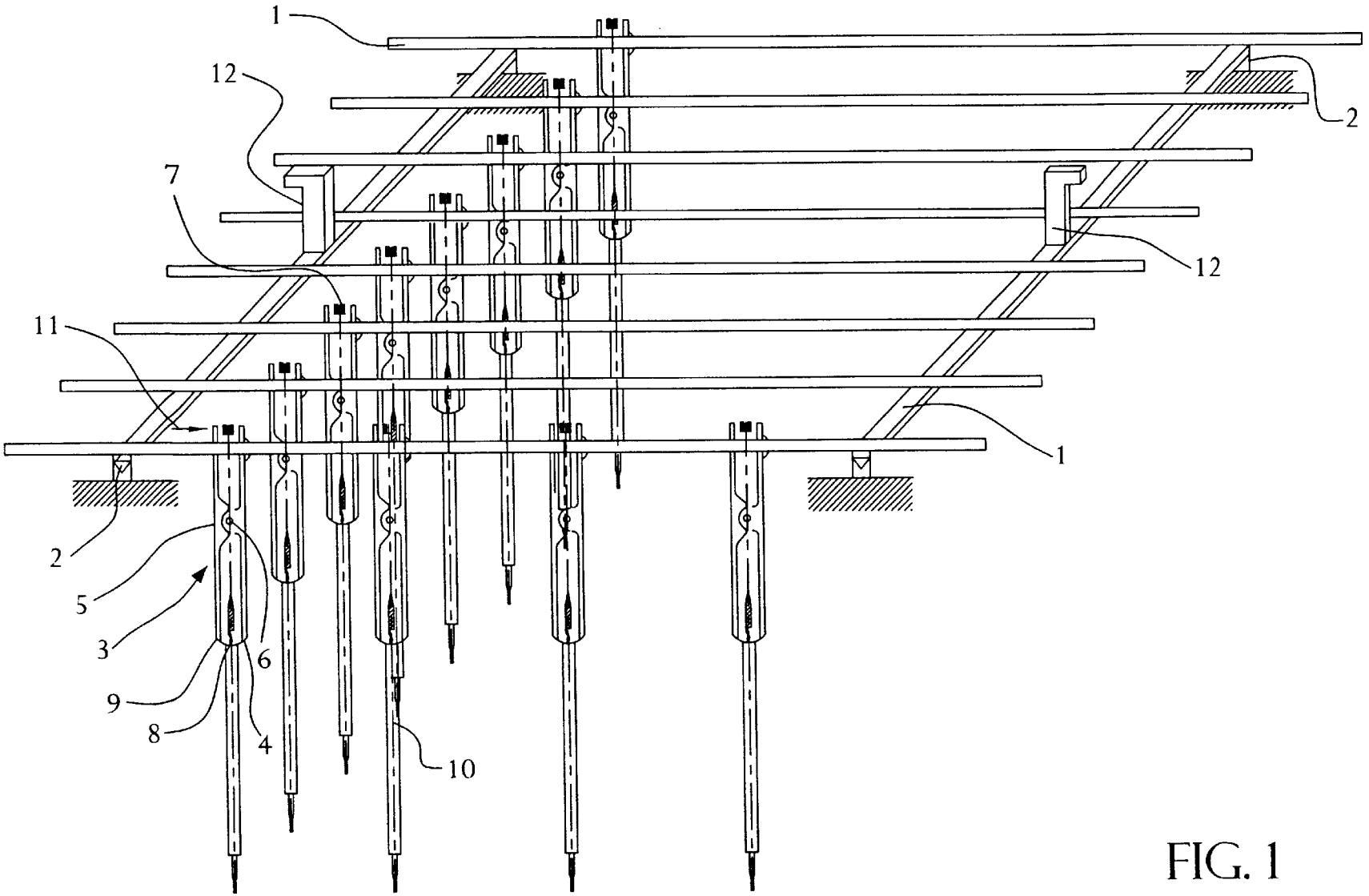
FIG. 1: goods carrier for transporting the item to be treated through the dip bath unit.

The goods carrier shown in FIG. 1 consists of a multipart frame 1 which is mounted on the frame supports 2 on the container for the treatment liquid. On the frame there are attached pincer-shaped clamps 3. The clamps consist of a stationary member 4 and a moving member 5. The latter is located rotatably with an axis 6 in the member 4. Via a powerful compression spring 7, the jaws 8 and 9 of the members on the clamp are pressed back against one another. The clamp 8 on the stationary member is curved inwards with a cross-section which is preferably trapezoid. The jaw 9 on the moving member has the convex profile which is shown curved outwards. Hence, bars 10 with varying shaft diameters can be clamped. During clamping they are aligned in the prism-shaped jaw exactly in the longitudinal direction of the clamps. In the representation of FIG. 1, the bars are arranged vertically. The clamps 8 and 9 may of course be secured to the members in reverse configuration.

The bars are clamped or released by exerting pressure on the moving member 5. Pressure, for example exerted by a pressure cylinder in the direction of the arrow 11, opens the clamp 3. All the clamps on the goods carrier are opened or closed using known methods and means of mechanical engineering. The latter are therefore not shown. A goods carrier can clamp for example 32 bars in the loading station. This procedure and also the emptying procedure may be automated simply, even when the dimensions of the bars change. The dimensions of the bars to be processed are the same at least in each row in the goods carrier.

The carrying arms 12 are used for transporting the goods carrier by means of a transportation vehicle from bath to bath. The frame 1 and the frame supports 2 and also all the clamp parts are configured to be electrically conductive. The bath current is supplied to the goods carrier via the frame supports and hence to the item to be treated, i.e. the bars 10. When large currents are used, the points of support are clamped for secure current conduction. In this case, the frames are made suitably of copper with a covering of titanium for protection against corrosion. During plating, the lower region of the metallic clamp dipping into the bath can, if necessary, be minimally plated. For that reason, at least this region of the clamps is provided with an insulating layer up to the jaws. If required, the jaws are chemically or electrolytically deplated in an appropriate bath.

Figure 2A:
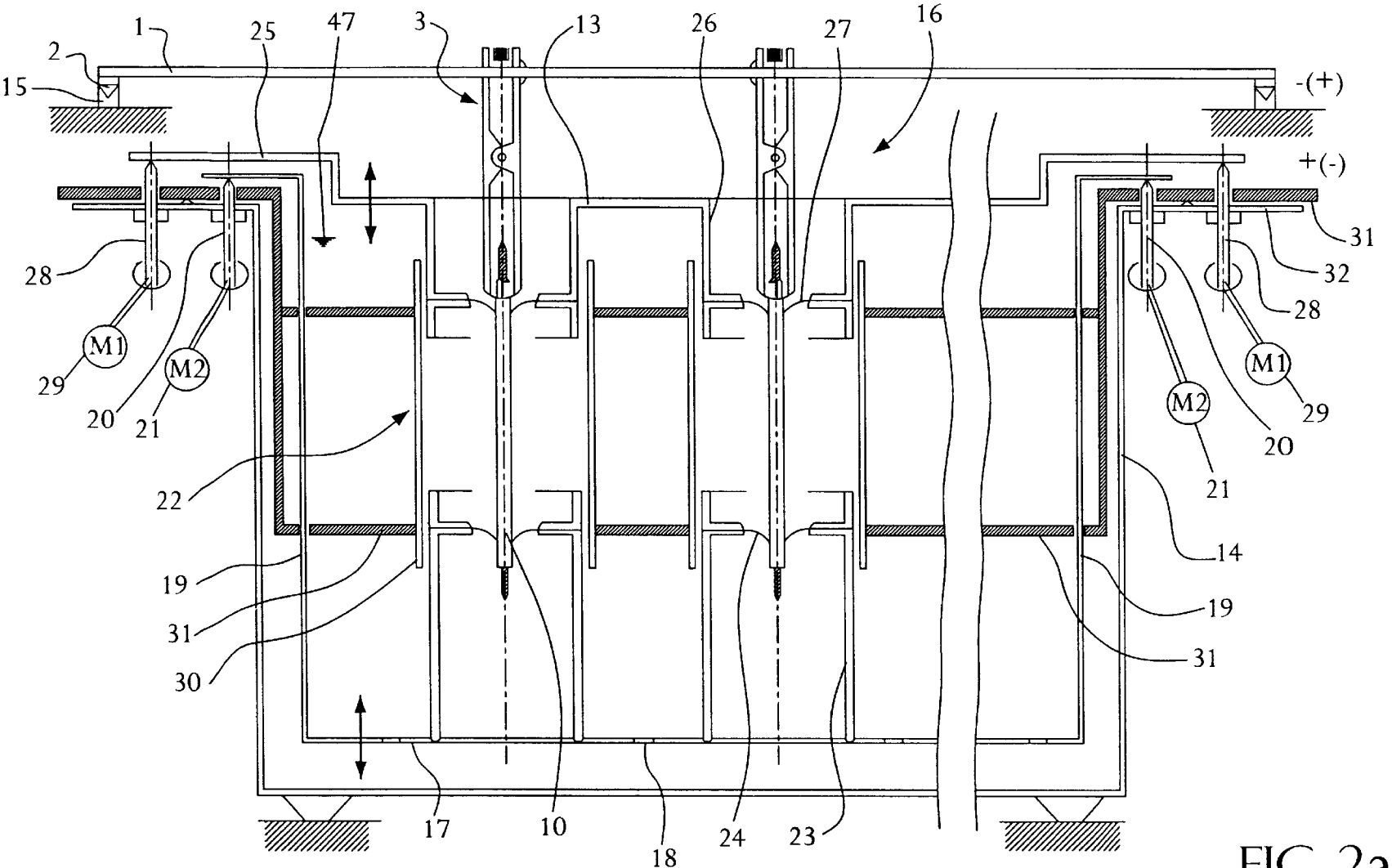
FIG. 2*a:* schematic side view of a treatment station, in part section.
Figure 2B:
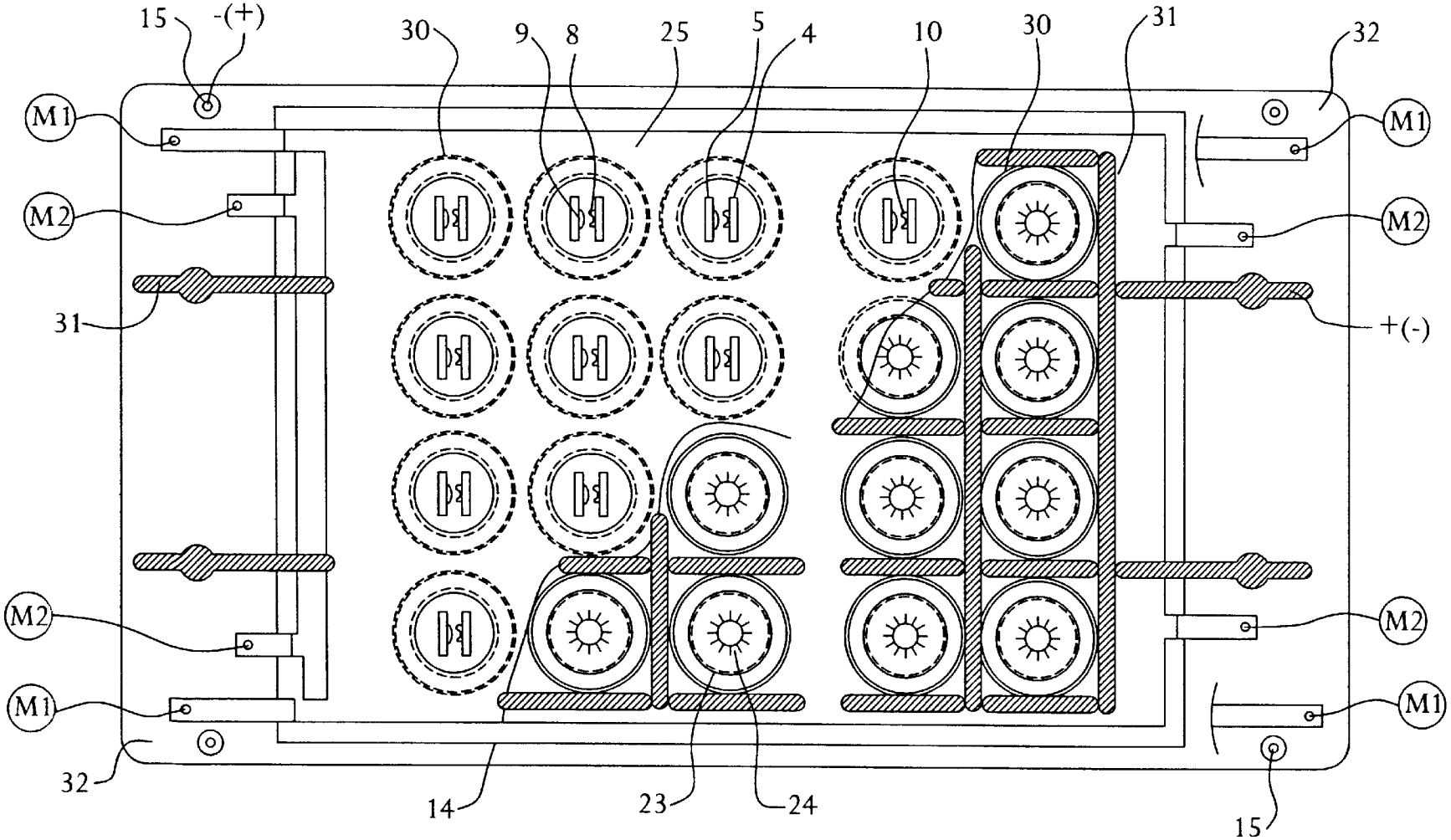
FIG. 2*b:* schematic plan view of a treatment station, in part section.

In the treatment station shown in the FIGS. 2*a* and 2*b*, the goods carrier is deposited on the goods carrier receivers 15. By means of the frame supports 2 and the goods carrier receivers 15, the goods carrier is positioned exactly in the treatment bath 16. In the treatment bath with the treatment container 14 there are installed:

Adjustable lower screen carriers 17:

The screen carrier is a plastic plate which is provided with openings 18 for the electrolyte exchange and which has lateral carriers 19. The carriers are located on both sides on height adjustment devices 20 which are moved in a specific manner by symbolically represented drives 21. On the screen carrier there are located for each single cell 22 one tube-shaped electrically non-conductive mask 23. This is also sealed above with an elastic collar 24 which has a concentric hole. Through this hole there projects the lower part of the bar which should not be treated electrochemically.

Adjustable upper screen carrier 25:

The screen carrier comprises a plastic plate 13 which bears all the upper tube-shaped masks 26. At the same time, this plate covers the normally hot bath. As a result, the escape of aggressive fumes is greatly reduced. The masks are sealed at the bottom with an elastic collar 27 respectively. The bar to be treated projects into the single cell 22 through a concentric hole in the collar. The upper screen carrier is positioned on both sides on height adjustment devices 28 which are moved in a specific manner by symbolically represented drives.

Electrodes 30 for forming the single cells 22:

A tube-shaped electrode 30 is installed in a stationary manner in the treatment bath 16 for each single cell 22 respectively. The electrodes are secured in an electrode holder 31 in an electrically conductive manner. The holder is constructed in such a way that, when the goods carrier has been deposited, the bars to be treated are positioned centrally in the tube-shaped electrode 30.

By means of the unit transportation device and the goods carrier, the bars 10 to be treated are put into the single cells 22 and positioned there exactly in the x, y and z axes. The region of the bar to be treated electrochemically is delimited in each single cell both above and below by the masks 23, 26 and also the collars 24, 27. The position of the boundary is set specifically for each item to be treated, for one row on the goods carrier or for the entire goods carrier. By means of the height adjustment devices 20, 28, the boundary is set automatically for each individual goods carrier. If there are varying lengths of bars to be treated per row on the goods carrier, the boundaries are adjusted individually for each row. The control values for the adjustments are conveyed to the control system of the dip bath unit during loading of the goods carrier. Via the fine-tuning adjustment devices 20, 28, the height of the upper and lower screen carriers is set on the basis of these control values. The actual height values are reported back to the control system from the unit. This device makes possible a precise partial treatment of bars with greatly varying dimensions in one bath container without having to refit the latter or the goods carrier. The polarity of the bath current supplies for electrochemical plating is shown in FIGS. 2*a* and 2*b*. The polarity, which is given in brackets, is valid for the electrochemical etching procedure.

In FIG. 2*b*, the treatment station is shown without a goods carrier in plan view. The bars 10, the jaws 8, 9 and the members 4, 5 of the clamp are portrayed as individual parts of the goods carrier. In the right-hand part of the Figure, the upper screen carrier 25 is not shown in order to permit a view of the electrodes 30, the electrode holder 31 and also the lower mask 23 and the lower collar 24. The individual drives M1 and M2 for the height adjustments, which for reasons of depiction are shown in a simplified manner, can also be realised by one drive respectively for all the support points of a screen carrier. Drive elements such as shafts and gearwheels take care of parallel height adjustment. The actual position of the screen carriers is relayed back to the control system by transmission means (not shown). Said control system is thus in a position to initiate each predetermined position of the screen carriers in a specific manner.

The respective correct position of the screen carriers 17, 25 can be initiated before or also after deposition of the goods carrier into the bath container 14.

Figure 3:
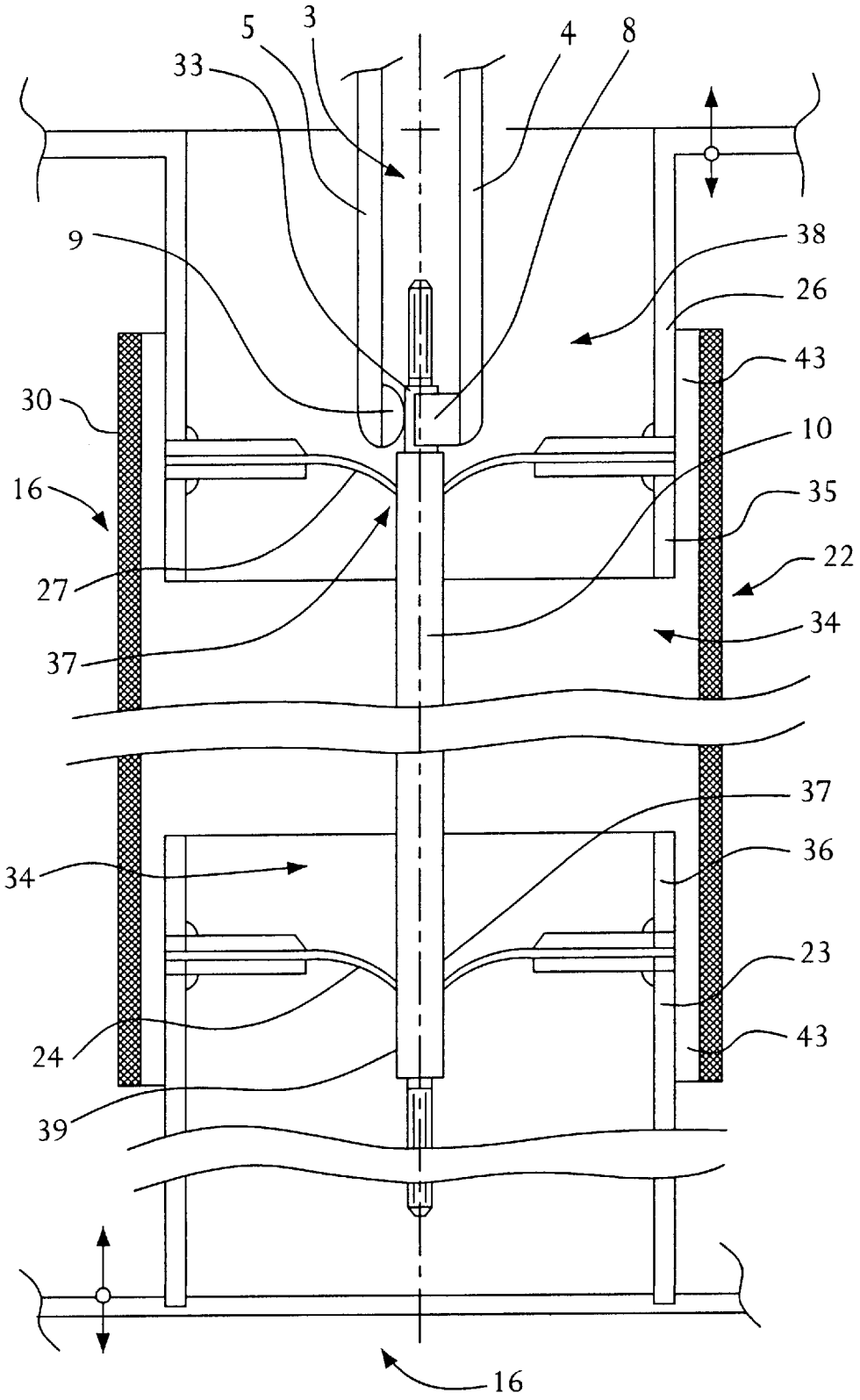
FIG. 3: single cell in cross section.

In FIG. 3, details of the single cell 22 are shown. The bar 10 to be treated may as a rule have several turned shoulders 30, partially threaded. The jaws 8 and 9 grip the bar at the projection 33. Via the jaws 9, a half cylinder, the bar is in contact at one point and pressed into the prism-shaped jaw 8 for exact alignment. Both jaws are made of an abrasion-resistant, corrosion-resistant and an efficient electrically conductive material. It is practical to secure the jaws to the members of the clamps so that they may be exchanged. The tube-shaped masks 23, 26, which are arranged in the electrode 30, can be adjusted height-wise. They are arranged concentrically to the electrode.

The coverings for the bars, in the present case mask tubes, are provided on the side pointing to the treatment chamber 34 with an extension 35 above and with an extension 36 below. These extensions mask the end of the surfaces to be treated in such a way that no increase or drop in current density occurs towards the boundary point 37 which is formed by the collars 24, 27. Without these extensions, an increase in current density and hence in layer thickness (so-called bone effect) occurs for example during electrolytic plating. These extensions are not restricted to a cylindrical tube extension. On the contrary, these extensions can also have other forms to fit the single cell. For example, funnel-shaped mask seals in both directions, i.e. tapered or gaping funnels are also suitable. Furthermore, the extensions can also be provided with openings.

Figure 5:
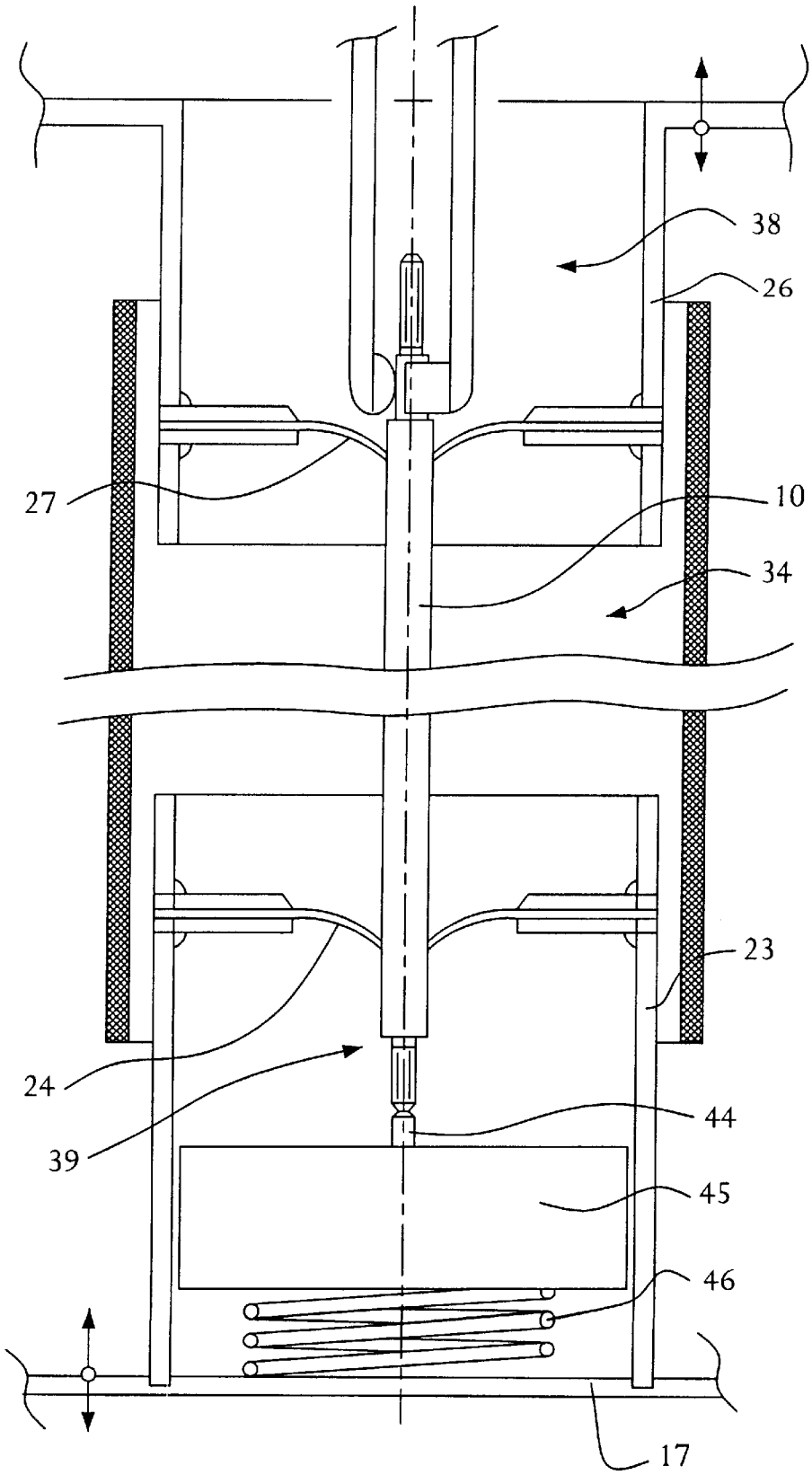
FIG. 5: single cell in cross section, variant with additional metallic body in the lower screening area.

The effect of a funnel-shaped mask seal is already achieved by the collars 24, 27 too if the bar to be treated is directed through the collars (FIG. 3). A form which is identical above and below, directed namely towards the treatment section of the bar or away from it, can thereby be achieved, the upper or lower mask being moved a little in the direction of penetration after introducing the bar. In FIG. 5, a curve of the collar is shown of the type achieved when the bar is moved in a downwards direction. If the upper mask 26 is subsequently moved again slightly downwards after introducing the bar then the collar 27 is turned up so that, as with the collar 24 in the lower position, a tent-shaped collar form is produced directed towards the treatment chamber 34.

Outwith the treatment chamber 34, the zero-field chamber 38 is situated above and the zero-field chamber 39 below. In these chambers, as is intended, no electrochemical treatment takes place. The collars 24, 27 surround the bar 10 tightly. They are made preferably of an elastic material which is abrasion and corrosion-proof. Membranes made of plastic material, such as for example FPM (fluorine/rubber-plastic material) are suitable. The collars have a round opening which is no bigger than the smallest bar diameter at the boundary point 37. They are secured in the tube in such a manner that the opening lies in the centre of the mask. In order to equalise the tolerances, a collar which can float can also be secured in the tube-shaped masks. The collar then sits closely against the bar even when the axes of the bar 10 and the masks 23, 26 are misaligned.

Figure 4:
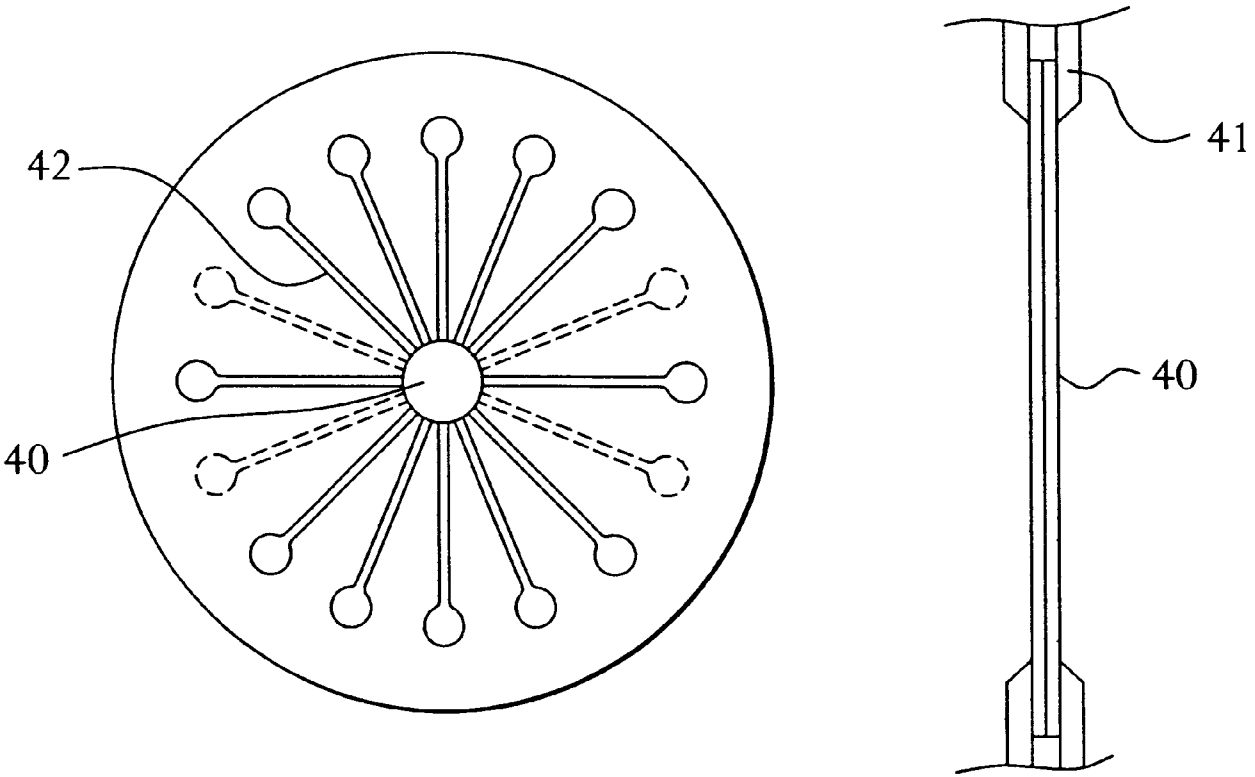
FIG. 4: collar in plan view and in cross section for bars to be treated having a varying diameter.

In a particular embodiment, the collar is designed multi-layered and spring-mounted. This allows bars with large variations in diameter at the boundary point 37 to be treated. Hence, bars with very varying bar diameters can also be treated when the collars remain in the unit for a long time. In FIG. 4, a collar of this type is shown. The individual layers are arranged offset against one another in such a way that the incisions 42 of a collar membrane are covered by the other membrane. The same is true for further layers also. It is also advantageous if the positions amongst themselves have stepped diameters of the central opening 40. In this case, the boundary point 37 can be set especially exactly with the smallest degree of abrasion. The layers are maintained by a collar fixing 41. The fixing is mounted securely or able to float in the mask.

Instead of the spring-mounted form of the collars 24, 27, the latter can also be designed in such a way that their thickness decreases in a radial direction from the outside to the centre. The thickness can decrease progressively, as is shown in FIG. 5, or in steps. This has the advantage that the collar is very flexible in the penetration area of the bar although the collar is very stable dimensionally in the region of the outer diameter. Consequently, little resistance is offered to the penetrating bar. Nevertheless, the sealing of the zero-field chambers 38, 39 is very reliable. As a result, with many shapes of item to be treated one collar at every boundary point of the surface to be treated suffices to guarantee reliable sealing.

In a further embodiment, the collar is made of electrically non-conductive brushes. The brushes are secured in the collar fixing and point radially to the centre of the collar. When the bristles are dense, reliable masking and a long service life can hereby also be achieved.

Although the requirement for zero-field chambers 38, 39 is essentially fulfilled by means of the measures described above, e.g. by using spring-mounted collars electrical field lines can penetrate from the treatment chamber 34 into the predominantly zero-field chambers when the tolerances are too great between the axis of the bar and the axis of the masks 23, 26. If the field line density in these chambers is so small that at the end regions of the bar which are not to be coated there occurs a current density lying below the threshold value for an electrolytic treatment, for example a metal deposition, no electrochemical treatment takes place. However, if the field line density in these chambers is so great that the threshold value is exceeded then the areas which are not to be treated are treated electrochemically. For example, metal is deposited. The layer which appears is indeed substantially thinner than the layer deposited in the region of the treatment chamber. Nevertheless, an additional, undesired treatment step is required for its removal.

While in the upper predominantly zero-field chamber 38 the threshold value of the current density, by means of which metal deposition takes place, is not achieved since the additional metal surfaces of the jaws 8, 9 contribute to delimiting the current density at the bar end, the threshold value can be more easily exceeded in the lower chamber 39. In order to prevent this, in a further embodiment of the invention, there is provided an enlargement of the metal surfaces located in this chamber 39, said surfaces being at the same electrical potential as the bar.

As is shown in FIG. 5, for this purpose a metal body 44 is also arranged in the centre of the chamber 39. Said body can be moved freely in an axial direction. In addition, it is secured to a retaining element 45 which is made of a non-conductive material and which is contained in the mask 23. The retaining element 45 can be designed either as a floating body so that it is pushed upwards in the liquid or it can be moved upwards by a spring 46 which is arranged between the retaining element and the lower screen carrier 17. With both measures, the metal body 44 sits tightly against the lower collar 24 if there is no bar in the single cell 22. When a bar is lowered into the single cell and hence into the chamber 39 the bar is brought into electrical contact with the metal body so that said body receives the same electrical potential as the bar.

The electrode 30 is configured preferably as an insoluble electrode. The electrode can be designed for example as a perforated tube so that a good electrolyte exchange can take place in the treatment chamber 34. An expanded metal mesh for example, from which the electrode is formed, is suitable. A further electrolyte exchange takes place through the gap 43 (FIG. 3). If the diameters of the masks 23, 26 and the inner diameter of the electrode are identical in size and if the masks are securely connected to the electrode the gap 43 disappears. In this case, the electrodes are telescopically adjustable with the mask adjustment. The electrolyte in the treatment chamber 34 is in this case exchanged solely via the electrode perforations. The surface of the electrode must be chemically and electrochemically resistant. Surface coatings of platinum or mixed oxides are resistant such that a long service life of the electrodes is achieved.

The electrodes are connected in an electrically conductive manner with the electrode holder. The bath current source is connected together with all the electrodes via this holder. For particularly precise or for individual treatment, an individual bath current source can be assigned to each electrode. In this case, the electrodes are secured to the electrode holder in an electrically insulated manner and are connected by an insulated cable to the respective current source. In special cases, the electrode can also be soluble.

All the presented features and combinations of the presented features are the subject of this invention as long as these are not designated exclusively as known.

REFERENCE NUMBER LIST

1. Frame
2. Frame supports
3. Clamp
4. Stationary member
5. Moving member
6. Axis
7. Compression spring
8. Inwardly curved jaw
9. Outwardly curved jaw
10. Bar (item to be treated)
11. Arrow for direction of force
12. Carrying arm
13. Plastic plate
14. Bath container
15. Goods carrier receiver
16. Treatment bath
17. Lower screen carrier
18. Openings
19. Carriers
20. Height adjustment device—lower
21. Drive M2
22. Single cell
23. Tube-shaped mask—lower
24. Collar—lower
25. Upper screen carrier
26. Tube-shaped mask - upper
27. Collar - upper
28. Height adjustment device - upper
29. Drive M1
30. Electrode
31. Electrode holder
32. Container edge
33. Shoulder
34. Treatment chamber
35. Projection—upper
36. Projection—lower
37. Boundary point
38. Zero-field chamber—upper
39. Zero-field chamber—lower
40. Central opening

41. Collar fixing

42. Incision

43. Gap

44. Metal body

45. Retaining element

46. Spring

47. Bath liquid level

We claim:

1. Device for the electrochemical treatment of elongate articles, comprising a) a container (14) for containing a treatment liquid, a1) with at least one electrode (30) contained therein for the electrochemical treatment of an article (10), a2) the electrode having a hollow chamber with a longitudinal axis and a periphery parallel to the axis into which hollow chamber the article may be inserted, b) at least one screening mask (23;26), which is arranged axially displaceable within the hollow chamber, is provided with openings (40) for introducing the article and which is designed in such a way that it comprises a means for restricting the flow of the electrolyte to certain areas so that it substantially prevents electrochemical treatment of the article in certain areas, and c) at least one current source and electrical connections from one connection terminal of the current source to the electrode and from the other connection terminal to the article which may be introduced into the electrode.

2. Device according to claim 1, characterised in that, the screening mask (23;26) is designed as a covering partly surrounding the article (10) in an axial direction.

3. Device according to claim 2, characterised by a projection (35;36) of the covering (23;26) surrounding the article (10) into the area which is to be treated electrochemically.

4. Device according to one of the claims 1 and 2, characterised by a sealing means (24;27) on the screening mask (23;26), said sealing means sitting tightly against the periphery of the hollow chamber and establishing a boundary of the area to be treated electrochemically.

5. Device according to claim 4, characterised in that the sealing means (24;27) has an opening (40) for introducing the article (10).

6. Device according to claim 4, characterised by a further sealing means lying above the first sealing means (24;27), both sealing means (24;27) having an opening (40) respectively for introducing the article and radial incisions (42) extending towards the openings and the incisions (42) of both sealing means (24;27) being arranged offset to one another.

7. Device according to claim 5, characterised by sealing means (24;27) with thickness decreasing towards the opening.

8. Device according to one of the claims 1 to 2, characterised by a tube-shaped hollow chamber.

9. Device according to any one of claims 1 or 2, characterised by several sealing means (24;27) lying one above the other and having openings (40) with different diameters.

10. Device according to one of the claims 1 to 2, characterised by at least one additional metal body (44) which is connected electrically to the article (10) and which is arranged in the area not to be treated, in an axial direction spaced apart from the sealing means (24;27).

11. Device according to one of the claims 1 to 2, characterised by a fixing device (13;17) for the screening mask (23;26) and a device for the axial height adjustment (20;28) of the screening mask.

12. Device according to one of the claims 1 to 2, characterised by a clamp (3) carried by the device formed a stationary member (4) and a moving member (5) and also jaws (8;9) carried by the members.

13. Device according to claim 12, characterised by a means (5) exerting a closing force on the jaws (8;9).

14. Device according to one of the claims 1 to 2, characterised by perforated electrodes (30).

* * * * *